US007647824B2

(12) United States Patent
Wu et al.

(10) Patent No.: US 7,647,824 B2
(45) Date of Patent: Jan. 19, 2010

(54) SYSTEM AND METHOD FOR ESTIMATING FORMATION SUPERCHARGE PRESSURE

(75) Inventors: Jianghui Wu, Houston, TX (US); Jaedong Lee, Katy, TX (US); Matthias Meister, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 150 days.

(21) Appl. No.: 11/737,223

(22) Filed: Apr. 19, 2007

(65) Prior Publication Data

US 2007/0256489 A1 Nov. 8, 2007

Related U.S. Application Data

(60) Provisional application No. 60/793,484, filed on Apr. 20, 2006.

(51) Int. Cl.
*E21B 47/06* (2006.01)
*G01V 9/00* (2006.01)

(52) U.S. Cl. ..... 73/152.02; 702/12

(58) Field of Classification Search ..... 73/152.22, 73/152.39, 152.02, 152.51; 166/101, 120, 166/250.01, 255.1, 255.2, 324, 370; 702/12; *E21B 47/00*
See application file for complete search history.

(56) References Cited

U.S. PATENT DOCUMENTS 5,644,076 A 7/1997 Proett et al.
6,609,568 B2 * 8/2003 Krueger et al. ..... 166/250.07
7,031,841 B2 4/2006 Zazovsky et al.
2002/0173915 A1 * 11/2002 Egermann et al. ..... 702/12
2005/0171699 A1 * 8/2005 Zazovsky et al. ..... 702/11
2005/0235745 A1 * 10/2005 Proett et al. ..... 73/152.22
2006/0069511 A1 * 3/2006 Thambynayagam et al. .. 702/12
2006/0129365 A1 6/2006 Hammond
2007/0079652 A1 * 4/2007 Craig ..... 73/152.22

OTHER PUBLICATIONS

Chang et al., "When Should We Worry About Supercharging in Formation Pressure While Drilling Measurements?", SPE 92380, pp. 1-15, Amsterdam, Feb. 23-25, 2005.
Wu et al., "The Influence of Water-Base Mud Properties and Petrophysical Parameters on Mudcake Growth, Filtrate Invasion, and Formation Pressure", Petrophysics, vol. 46, No. 1, pp. 14-32, Houston, TX, Feb. 2005.
Hammond et al., "Correcting Supercharging in Formation-Pressure Measurements Made While Drilling", SPE 95710, pp. 1-13, Dallas, TX, Oct. 9-12, 2005.
Zain et al.; "Mechanisms of Mudcake Removal During Flowback," SPE Drilling & Completion, Dec. 2001, pp. 214-220.

* cited by examiner

*Primary Examiner*—John Fitzgerald
(74) *Attorney, Agent, or Firm*—Madan & Sriram, P.C.

(57) ABSTRACT

A method of estimating a formation pressure in a wellbore is provided that in one aspect includes measuring a hydrostatic pressure at a selected location in the wellbore, and estimating supercharge pressure as a function of time using a forward model that utilizes the hydrostatic pressure and at least one property of mud in the wellbore that is a function of time. In another aspect, the method may estimate an initial formation pressure at a selected location in a wellbore by obtaining a hydrostatic pressure and at least three formation pressure measurements at three separate times at the selected location, and estimating the initial formation pressure using the hydrostatic pressure, the three pressure measurements and an internal mudcake parameter.

22 Claims, 11 Drawing Sheets

*Table 1*

| Inversion result | Field Case 1 | | |
|---|---|---|---|
| | 1-A (L-M) | 1-A (G-N) | 1-B (L-M) |
| Total iterations | 24 | 44 | 15 |
| Function evaluations | 238 | 460 | 166 |
| Initial pressure $P_i$, psi | 5021.5 | 5020.0 | 5020.0 |
| $k_{mc0}$, mD | 2.51e-3 | 2.40e-3 | 5.31e-3 |
| $\lambda_{mc1}$ | 0.549 | 0.599 | 0.713 |
| $\lambda_{mc2}$ | 1.88 | 2.08 | 2.10 |
| Skin S | 3.56 | 4.08 | 3.90 |
| Exponent v | 0.703 | 0.695 | 0.704 |
| Thickness lme0, cm | N/A | N/A | 0.034 |
| Squared-sum of the residual | 0.0319 | 0.500 | 1.19e-6 |

*FIG. 16*

*Table 2*

| Inversion result | Inversion result |
|---|---|
| Total iterations | 9 |
| Function evaluations | 90 |
| Initial pressure $P_i$, psi | 2823.8 |
| $k_{mc0}$, mD | 5.97e-3 |
| Compaction factor $\lambda_{mc1}$ | 0.130 |
| Compaction factor $\lambda_{mc2}$ | 1.885 |
| Skin S | 2.664 |
| Compressibility exponent v | 0.663 |
| Squared-sum of the residual | 0.113 |

*FIG. 17*

SYSTEM AND METHOD FOR ESTIMATING FORMATION SUPERCHARGE PRESSURE

CROSS-REFERENCE TO RELATED APPLICATIONS

This application claims priority from U.S. Provisional Application Ser. No. 60/793,484, filed Apr. 20, 2006.

BACKGROUND OF THE DISCLOSURE

1. Field of the Invention

This disclosure relates generally to estimating downhole formation pressures.

2. Description of the Related Art

Formation testers are used to measure formation pressures at discrete depths to determine pressure gradients for zones of interest. The pressure gradients are used to identify fluid types and to determine hydraulic connectivity between wells. Pressure gradient quality depends upon the accuracy of the formation pressure measurement. Pressure measurement values are also used to estimate the level of pressure depletion, to check connectivity between different zones, and to control the equivalent circulation density (ECD) during drilling of the wells. Therefore, making accurate pressure measurement at each depth is highly desirable.

Wells are commonly drilled wherein the pressure in the well due to the weight of the drilling mud column is greater than the connate formation pressure. Such a drilling is referred to as drilling under an overbalanced pressure or an overburdened condition. During overbalanced drilling, the drilling mud invades or penetrates the permeable rocks (formation) penetrated by the well. This mud filtrate invasion causes pressure supercharging, which is defined as the increased pressure observed at the wellbore sandface (i.e., at the wellbore wall). Pressure supercharging typically is a function of the mudcake quality (permeability and thickness), pressure overbalance, and formation permeability. The time period for which a formation is exposed to the overbalanced pressure also can also affect the amount of the supercharging. The formation pressure measurements are often affected by the amount of supercharging. Therefore, it is desirable to eliminate the pressure supercharging effect by subtracting the supercharged pressure from the measured pressure. One method for eliminating the supercharging effect is to pump the formation fluid from the formation for a relatively long time period with a large pressure drop, especially in low permeability formations. Such a method is generally not practical, especially in logging-while-drilling (LWD) environments, If the mudcake is leaky, even pumping for a long time may not necessarily eliminate the supercharging effect. Thus, estimating the amount of pressure supercharging offers a viable alternative.

SUMMARY OF THE DISCLOSURE

In one aspect, a method is provided for estimating a formation pressure that includes the features of measuring a hydrostatic pressure at a selected location in the wellbore, and estimating the supercharging pressure as a function of time using a forward model that utilizes a hydrostatic pressure and at least one property of the mud in the wellbore that is a function of time. In another aspect, the method may estimate an initial formation pressure at a selected location in a wellbore by using a model that uses as inputs a measured value of a hydrostatic pressure, at least three formation pressure measurements taken at the selected location at three separate times and an internal mudcake parameter.

In another aspect, an apparatus for estimating an initial pressure in a wellbore is disclosed that includes a pressure sensor that is configured to measure the hydrostatic pressure at a selected location in the wellbore, a memory device that stores a forward model that utilizes as inputs the hydrostatic pressure and at least one property of the mud as a function of time, and a processor associated that is configured to use the forward model to estimate the initial pressure of the formation at the selected location. In another aspect, the processor may estimate the initial formation by using the hydrostatic pressure, at least three pressure measurements taken at the same location at three different times and a model that uses a property of the mudcake.

Examples of the more important features of the method and apparatus for estimating formation pressure have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For detailed understanding of the methods and apparatus disclosed herein, references should be made to the following detailed description of the disclosure taken in conjunction with the accompanying drawings, in which like elements have generally been designated by like numerals, wherein:

FIGS. 1*a* & 1*b* show sandface supercharged pressure for a Field Case 1, Scenario 1-A, wherein FIG. 1*b* is an enlargement of the FIG. 1*a*.

FIGS. 4*a* & 4*b* show sandface supercharged pressure for the Field Case 1, Scenario 1-B, wherein FIG. 4*b* is an enlargement of FIG. 4*a*.

FIGS. 8*a* & 8*b* show sandface supercharged pressure for the Field Case 2, wherein FIG. 8*b* is an enlargement of FIG. 8*a*.

FIG. 11*b* is an enlargement of FIG. 11*a*.

FIG. 16 is a table showing certain inversion results of a fourth field case.

FIG. 17 is a table showing inversion results for a second field case.

DETAILED DESCRIPTION OF THE EMBODIMENTS

Figure 1A:
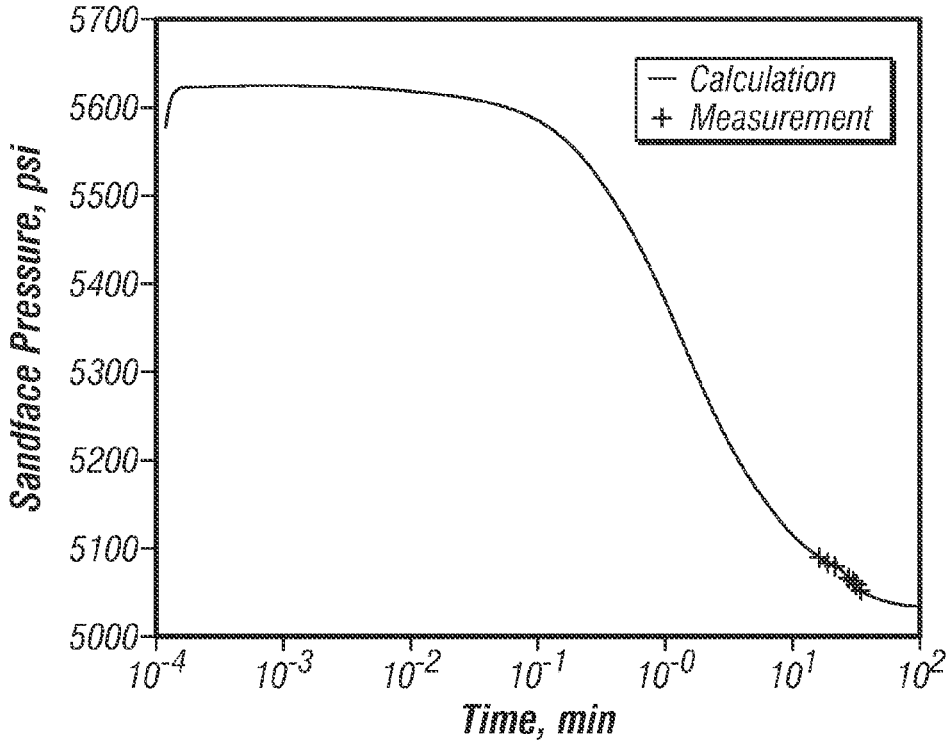

The present disclosure provides a system and method for estimating the amount of supercharging and the initial pressure of the formation. In one aspect of the disclosure, a forward model is used to estimate the supercharging pressure, given overbalance pressure, as well as mud and formation properties. In one aspect, the model couples a fluid flow model and a mudcake growth model. In one aspect of the model, overbalanced pressure and mud properties are treated as functions of time. In another aspect skin (skin effect) may be used to account for internal mud cake. In another aspect, mudcake permeability may be treated as a function of pressure by the model. Internal mudcake forms during the period of rapid fluid invasion (spurt loss) when the drill bit first makes contacts with the formation. While the external mudcake may be scraped, the internal mudcake may be assumed to remain substantially unchanged during ensuing events, such as an overbalance pressure change and/or pressure testing. In another aspect of the disclosure, a general inversion algorithm that matches the calculated and observed or measured pressures is used to obtain the initial formation pressure. For the purpose of explaining the use of the forward model, as described later, two field cases are used to test the inversion algorithm. As described later, Field Case 1 inverts model parameters by matching build-up pressure measurements from repeat pressure test. (i.e. repeated measurements made at the same location). Two compaction factors are included in model parameters to account for changing mudcake growth rate resulting from time-varying hydrostatic pressure. Field Case 2 is similar to Field Case 1. All field data were collected using a formation testing tool. A sensitivity study shows that the maximum thickness of mudcake affects the sand face pressure prediction. The estimated initial formation pressure is in good agreement with the time-lapse logging-while-drilling (LWD) pressure measurements.

In one aspect of the present disclosure, to estimate the supercharge pressure, a forward model that utilizes a solution of transient pressure at the sandface in Laplace transform domain is used. The solution for transient pressure in time domain is obtained from Laplace transform by using a numerical inversion algorithm. For the invasion simulation, wellbore storage effects are not considered. The simplified form of solution in Laplace domain is described by Eq. 1, $$\Delta P_{ss}(s) = \frac{q\beta\mu}{2\pi kh}\frac{K_0(\sqrt{s/\eta}\,r_w) + S\sqrt{s/\eta}\,r_w K_1(\sqrt{s/\eta}\,r_w)}{s\sqrt{s/\eta}\,r_w K_1(\sqrt{s/\eta}\,r_w)}, \tag{1}$$

$$\eta = \frac{k}{\phi c_t \mu}, \tag{2a}$$

$$\Delta P_{ss}(t) = P_{ss}(t) - P_i, \tag{2b}$$

where $\Delta P_{ss}(s)$ is the sandface supercharge pressure change in the Laplace transform domain, $\Delta P_{ss}(t)$ is the sandface supercharge pressure change in the time domain, $P_{ss}$ is the sandface supercharge pressure, $P_i$ is the initial formation pressure, q is the injection rate (invasion rate in this case), B is the formation volume factor (B equals 1 in the supercharge case), $\mu$ is the fluid viscosity, s is the independent variable in the Laplace domain, $r_w$ is the wellbore radius, $\eta$ is the diffusivity constant, $\phi$ is the formation porosity, $c_t$ is the total compressibility, k is the formation permeability, h is the formation thickness, S is the skin or skin factor (internal mudcake), t is time, and $K_n$ is the modified Bessel function of order n of the second kind (n=0,1). The injection rate (invasion rate) "q" may be calculated from Eq. 3, $$q = \frac{2\pi r_w h k_{mc}(t)}{\mu l_{mc}(t)}[P_{mh}(t) - P_{ss}(t)], \tag{3}$$

where $k_{mc}$ is the mudcake permeability, $P_{mh}$ is the wellbore mud hydrostatic pressure, $P_{ss}$ is the sandface supercharge pressure, and $l_{mc}$ is the mudcake thickness. The mud case thickness (mc(t) may be obtained from a mudcake growth model.

Mudcake permeability $k_{mc}$ may be expressed as a function of pressure across mudcake as describe by Eq. 4, $$k_{mc}(t) = \frac{k_{mc0}}{[P_{mh}(t) - P_{ss}(t)]^v}, \tag{4}$$

where $k_{mc0}$ is a reference permeability defined at 1 psi differential pressure and v is a compressibility exponent, which is typically in the range of 0.4 to 0.9.

A mudcake thickness growth model that may be used to calculate the invasion rate is described by Eq. 5, $$\frac{dl_{mc}(t)}{dt} = \frac{k_{mc}(t)\cdot\lambda_{mc}(t)\cdot[P_{mh}(t) - P_{ss}(t)]}{\mu l_{mc}(t)}, \tag{5}$$

$$\lambda_{mc}(t) = \frac{f_s(t)}{[1 - f_s(t)]\cdot[1 - \phi_{mc}(t)]}, \tag{6}$$

where $\lambda_{mc}$ is mudcake compaction factor, $\phi_{mc}$ is mudcake porosity, $f_s$ is solid fraction of mud. When the thickness of mudcake reaches the predefined maximum thickness, it stops growing.

The time domain may be divided into several time steps, $t_1$, $t_2 \ldots t_n$. For the first time step $t_1$, mudcake is assumed to grow according to the rule of square root of time given by Eq. 7, $$l_{mc}(t_1) = \sqrt{\frac{2k_{mc}\lambda_{mc}\cdot(P_{mh} - P_{ss})\cdot t_1}{\mu}}, \tag{7}$$

where sandface supercharge pressure $P_{ss}$ is approximated to be the initial formation pressure $P_i$. Then mudcake permeability may be calculated from Eq. 4.

Equations 1, 3, 4, and 5 describe a single-phase invasion model for each of following time steps ($t_2$, $t_3 \ldots t_n$). After applying superposition to $P_{ss}$ for all the time periods, the sandface supercharge pressure $P_{ss}(t)$ can be calculated. Thus, the forward model couples a fluid flow model and a mudcake growth model that uses one or more time dependent parameters, such as $k_{mc}$ $P_{mh}$, $l_{mc}$, $\lambda_{mc}$, $\phi_{mc}$, and $f_s$.

Inversion is used to fit the forward model with pressure measurements to estimate the initial pressure. The objective function is the sum squared of the difference between measured and calculated sandface supercharge pressure $P_{ss}$. The model parameters include initial formation pressure $P_i$, reference mudcake permeability $k_{mc0}$, mudcake compressibility exponent v, mudcake compaction factor $\lambda_{mc}$, and skin S (internal mudcake). If the mudcake is scraped or the hydrostatic pressure changes between tests, one additional $\lambda_{mc}$ may be added to the parameter list to account for different mudcake growth rates. The inversions may be carried out by both Levenberg-Marquardt (L-M) and Gauss-Newton (G-N) optimization algorithms.

It is considered helpful to describe the use of the methods of the present disclosure in conjunction with field data. For this purpose two field cases are presented herein as examples. It is noted, however, that the inversion result is not unique. There may exist many combinations of aforementioned five/six model parameters to fit one set of repeat measurements (at least three pressure points). Therefore, at least two sets of repeat tests are used to reduce the non-uniqueness of inversion result. Even with two sets of repeat tests (a total of six pressure points), non-uniqueness of model parameters is possible. Take Field Case 1 as an example: one set of model parameters ($P_i$=5021.5 psi, $k_{mc0}=2.51\times10^{-3}$ mD, $\lambda_{mc1}$=0.549, $\lambda_{mc2}$=1.88, S=3.56, v=0.703) will fit pressure measurement perfectly as another set of model parameters ($P_i$=5021.7 psi, $k_{mc0}=1.52\times10^{-5}$ mD, $\lambda_{mc1}$=0.00256, $\lambda_{mc2}$=0.00904, S=2.87, v=0.720). Examining the values of the second set of model parameters shows that the value of $k_{mc0}$ ($1.52\times10^{-5}$ mD) is unrealistically small, which value normally should be in the range of $10^{-3}$ to $10^{-2}$ mD. For this "super" sealing mudcake (permeability is 0.006 times smaller) the inversion arrives at a correspondingly small compaction factor for the mudcake (i.e., 0.005 times smaller). This means that super sealing mudcake with both a very small value of permeability and compaction factor is equivalent to regular mudcake, as far as pressure measurements are concerned. This kind of non-uniqueness could be eliminated by specifying the correct ranges for model parameters. For example, the range of $k_{mc0}$ is $10^{-3}$ to $10^{-2}$ mD; the range for $\lambda_{mc}$ is 0.01 to 10; and v is in the range of 0.4 to 0.9.

Field Case 1

In the Field Case 1, two scenarios are described. In the first scenario (Scenario 1-A), the first test measurements were made 18 minutes after drilling, using a formation test tool, such as described in reference to FIG. 15 or a tool used during drilling of the well. This is a repeat pressure test case. The first scenario assumes that the actual time-since-drilled is unknown and an arbitrary time-since-drilled (t=18 minutes) is assigned to the time when the build-up pressure of the first test was measured.

Two sets of three repeat pressure tests were conducted at different hydrostatic pressures. The first set of pressure tests was conducted under 5626 psi hydrostatic pressure, then the hydrostatic pressure was lowered to 5417 psi at t equals 26 minutes, and then a second set of repeat pressure tests was conducted. The measured build-up pressures for the first set of repeat tests were 5087.72, 5083.63, and 5080.66 psi respectively, and the build-up pressures for the second set of repeat tests were 5055.75, 5053.25, and 5051.42 psi respectively. The decreasing trend of build-up pressure between the first and second set is believed to be the effect of lower hydrostatic pressure, indicating that the near-wellbore pressures are affected by the hydrostatic pressure, an indication of supercharging. The mudcake grows continuously during the repeat tests; therefore, the newly formed mudcake has a better sealing capacity resulting in decreasing sandface pressures for each repeat test in the set.

The objective function uses four pressure measurements (i.e., the first and third measurements from both sets of repeat tests). Inversion parameters include initial formation pressure $P_i$, reference mudcake permeability $k_{mc0}$, mudcake compaction factor $\lambda_{mc1}$ (e.g., when the hydrostatic pressure equals 5626 psi), mudcake compaction factor $\lambda_{mc2}$ (e.g., when the hydrostatic pressure equals 5417 psi), skin S, and mudcake compressibility exponent v. All of the other parameters are assumed to be known: total compressibility $c_t=3\times10^{-6}$ $psi^{-1}$; formation permeability=1.0 mD from formation test data analysis; formation porosity=0.15; fluid viscosity=1 cp; wellbore radius=10 cm; and the maximum mudcake thickness=0.2 cm. In this particular example, the hydrostatic pressure decreased to 5417 psi at 26 minutes since drilled and therefore the compaction factor is assumed to be a step function of time:

$$\lambda_{mc}(t<26\text{ minutes})=\lambda_{mc1}$$

$$\lambda_{mc}(t\geqq26\text{ minutes})=\lambda_{mc2}. \tag{8}$$

Figure 1B:
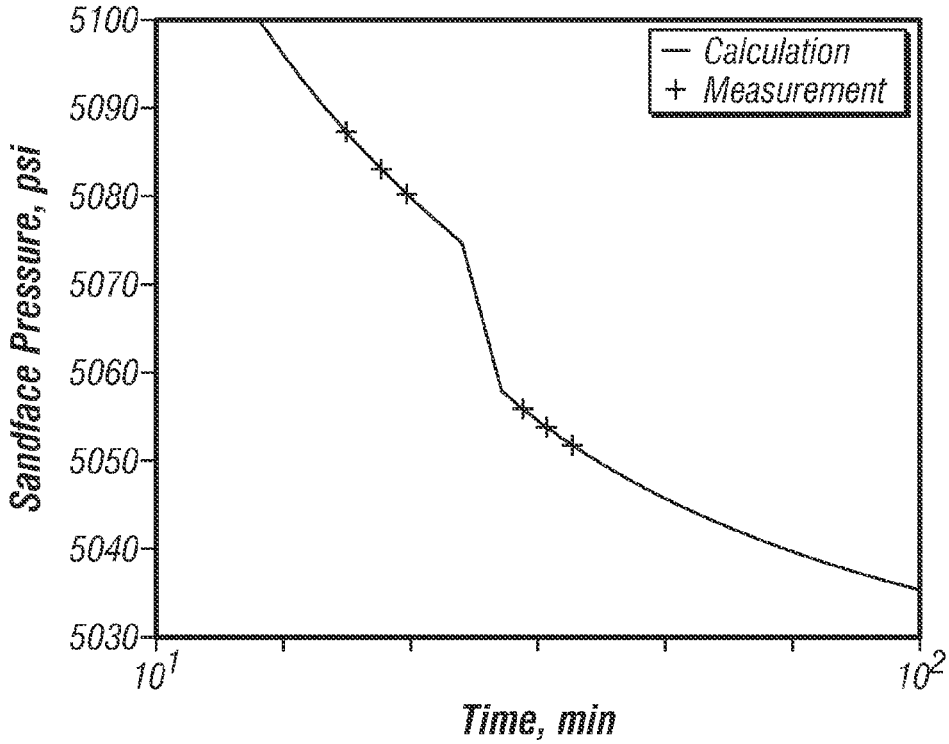
Figure 2:
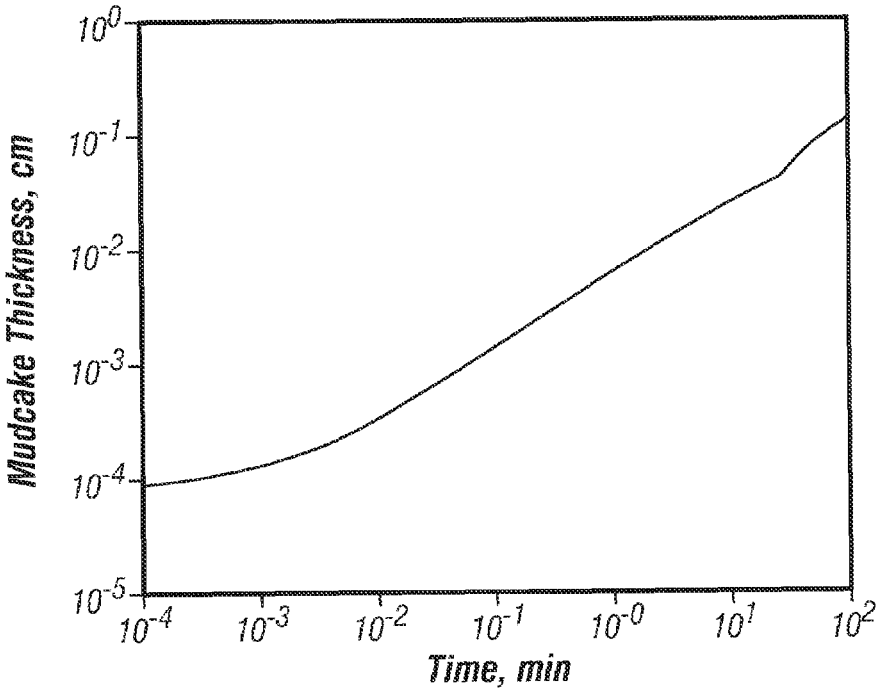
FIG. 2 shows time evolution of mudcake thickness for the Field Case 1, Scenario 1-A.
Figure 3:
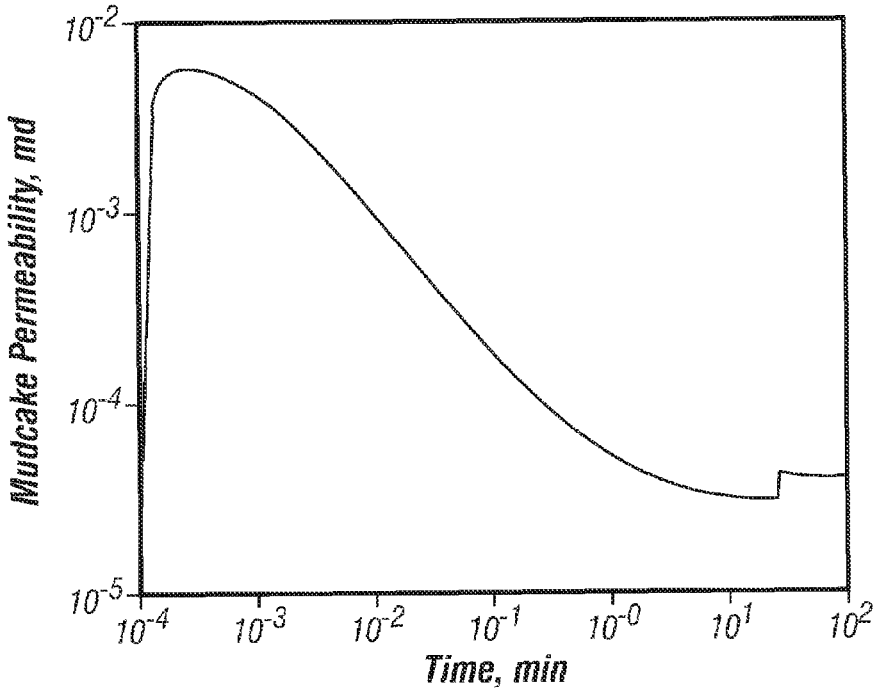
FIG. 3 shows time evolution of mudcake permeability for the Field Case 1, Scenario 1-A.

The starting point for inversion is chosen as $P_i$=5045 psi, $k_{mc0}=3.16\times10^{-3}$ mD, $\lambda_{mc1}$=1, $\lambda_{mc2}$=1, S=2.5, and v=0.6. The initial value for pressure may be calculated using the method described in reference to the alternative embodiment below. The initial values for mudcake properties were calculated from mud API test. The sensitivity study shows that final results are not sensitive to the starting point. The inversion results for both Levenberg-Marquardt (L-M) and Gauss-Newton (G-N) optimization algorithms are summarized in Table 1. (FIG. 16) It is clear that the residual of L-M method is smaller than that of G-N method, which means that the calculated pressures using L-M algorithm are closer to measurements. It is also noted that the G-N method is not as efficient as the L-M method in this case. However, the results show that all six parameters inverted from both methods are quite consistent. It is evident that even for the last build-up test, there still exists approximately 30 psi supercharging pressure (5051.4-5021.5 psi). Another observation is that the second compaction factor $\lambda_{mc2}$ is approximately 3.4 times of the $\lambda_{mc1}$, indicating that mudcake grows faster when mud circulating rate is decreased. FIGS. 1*a* & 1*b* show the sandface pressure using inversion results from the L-M method. Calculation results are from single-phase invasion model with input parameter shown in Table 1. The sandface pressure increases from initial formation pressure 5021.5 psi to 5625.7 psi within $2\times10^{-4}$ minute, and starts to decrease at t=0.1 minutes when the external mudcake grows to 0.002 cm. The pressure slumps at t=26 minutes, as a result of the 209 psi hydrostatic pressure decrease. FIGS. 2 and 3 show the time evolution of mudcake thickness and permeability, respectively. Calculation results are from single-phase invasion model with input parameter shown in Table 1. It is observed that the values of both mudcake thickness and permeability change suddenly at t=26 minutes when the hydrostatic pressure decreased. During very early time period ($10^{-4}$ minute<t<$2\times10^{-4}$ minute), the mudcake permeability increases due to decreasing pressure across mudcake (sandface pressure approaches hydrostatic pressure). Later, when sandface pressure declines, mudcake permeability stabilizes at $3\times10^{-4}$ mD; the sudden jump to $4\times10^{-4}$ mD at 26 minutes is a result of a 209 psi hydrostatic pressure drop.

The skin may be defined by the following equation:

$$S = \left(\frac{k}{k_s} - 1\right)\ln\left(\frac{r_s}{r_w}\right), \tag{9}$$

where k is the formation permeability, $k_s$ is the permeability of the "skin-damage" zone, $r_w$ is the wellbore radius, and $r_s$ is the radius of skin-damage zone. If $k_s$ is assumed to be $k_{mc0}$, the radius of skin-damage zone ($r_s$) could be calculated to be 10.09 cm. This means that the skin-damage zone has a thickness of 0.09 cm (i.e., $r_s - r_w$).

In the second scenario (Scenario 1B), the first test measurements were made 56 hours after drilling. This scenario is the same as the first scenario, except that the actual time-since-drilled is known for the inversion process. The first build-up pressure measurement was taken 3360 minutes (56 hours) since drilled. Normally, the mudcake will be fully "grown" to a maximum thickness after 56 hours of invasion and that the pressure measurement will show an upward trend. However, the actual pressure measurements show a downward trend, indicating that the mudcake was still growing. Assuming that prior to testing, the thickness of mudcake was reduced to a fraction of its maximum thickness by drill-string abration, the mudcake was allowed to grow. Therefore, one more inversion parameter $\mathbf{1}_{mc0}$ (mudcake thickness after scraping) is added to parameter list. The maximum mudcake thickness is set to 0.2 cm. It is assumed that the scraping occurred at t=3358 minutes, two minutes before testing commenced. The hydrostatic pressure decreases from 5626 psi to 5417 psi at 3368 minutes. The compaction factor is a step function of time:

$$\lambda_{mc}(t<3368 \text{ minutes}) = \lambda_{mc1}$$

$$\lambda_{mc}(t \geqq 3368 \text{ minutes}) = \lambda_{mc2}. \tag{10}$$

The inversion results using the L-M method are summarized in Table 1. The initial formation pressure for Scenario 1-B is 5020.0 psi, which is close to the scenario 1-A results (i.e., 5021.5 psi). The second compaction factor $\lambda_{mc2}$ is approximately 3 times of the $\lambda_{mc1}$, this ratio is also similar to 1-A result ($\lambda_{mc2}$ is 3.4 times of $\lambda_{mc1}$). The mudcake thickness at 3358 minutes is 0.034 cm, which is quite close to the thickness obtained in Scenario 1-A at t=16 minutes (2 minutes before testing) as shown in FIG. 2. This observation indicates that the exact time of scraping is not important; if this event happens earlier, the inversion algorithm will determine a new thickness (the value will be smaller than 0.034 cm) for that earlier time, and the mudcake will grow to approximately 0.034 cm at 2 minutes before testing. The difference in the drilling history between 1-A and 1-B only affects one result of the inversion parameter: the mudcake permeability.

Figure 4A:
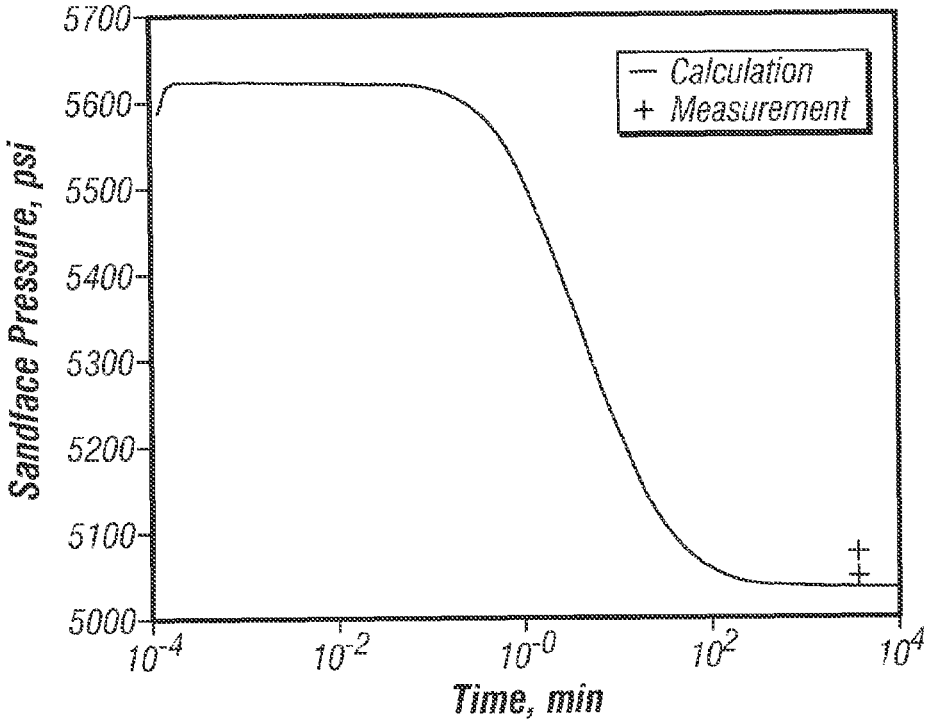
Figure 4B:
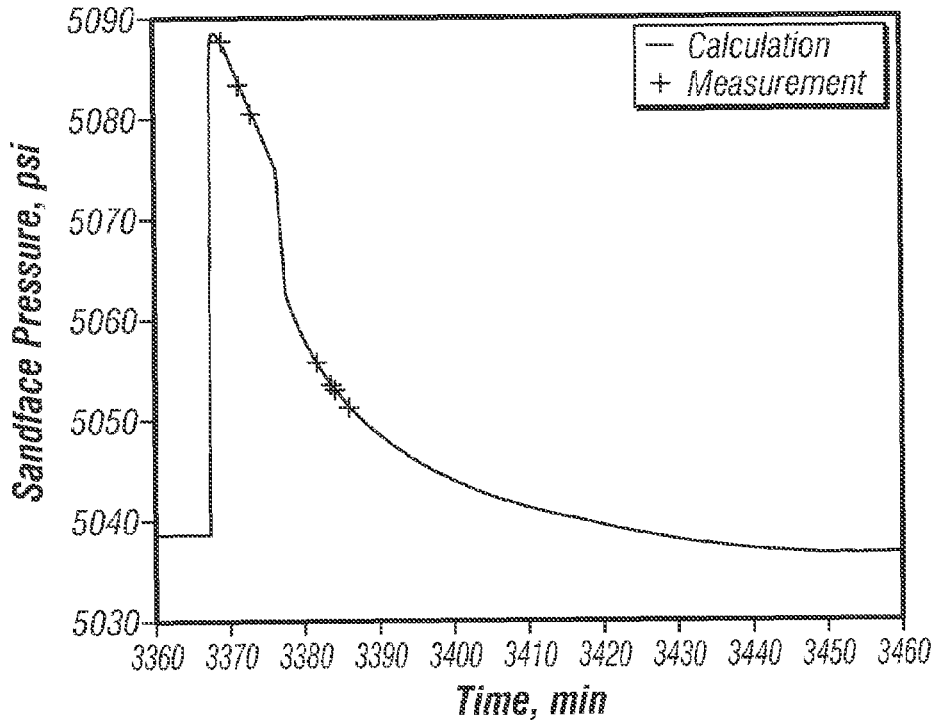
Figure 5:
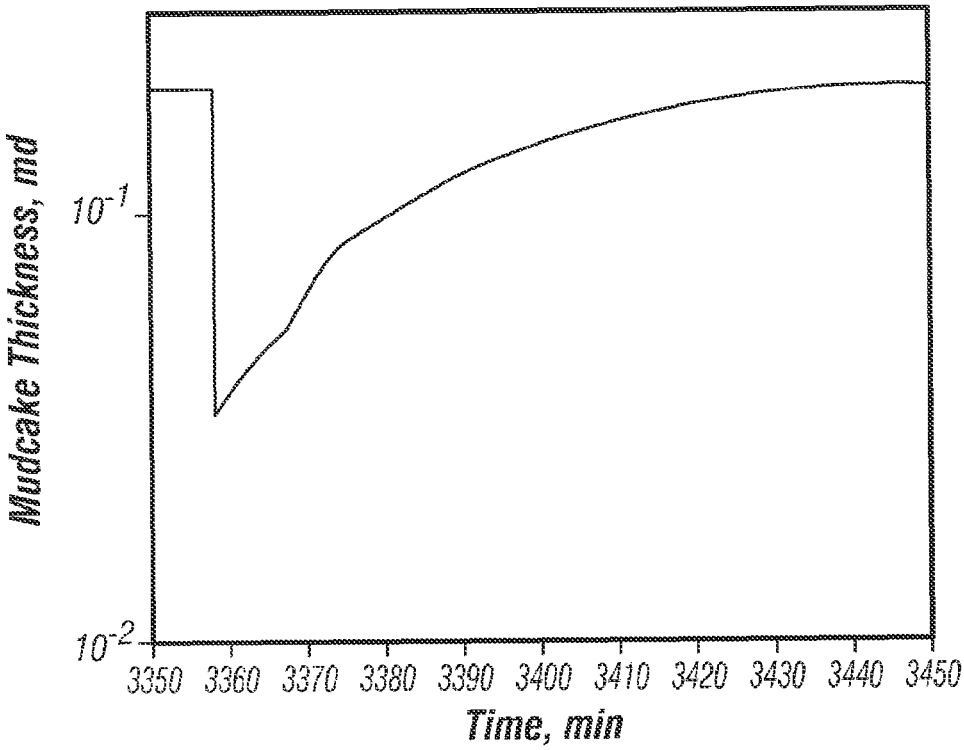
FIG. 5 shows time evolution of mudcake thickness for Field Case 1, Scenario 1-B.
Figure 6:
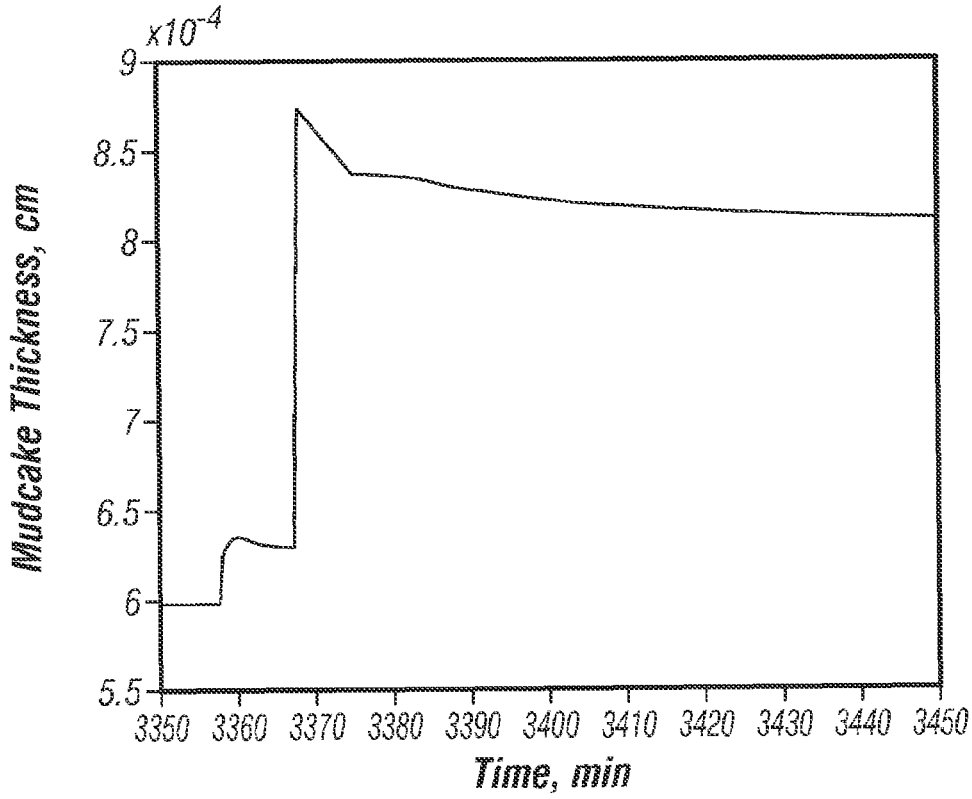
FIG. 6 shows time evolution of mudcake permeability for Field Case 1, Scenario 1-B.

FIGS. 4*a* & 4*b* show the sandface pressure from the inversion results for Scenario 1-B. Calculation results are from the single-phase invasion model with input parameter shown in Table 1. Immediately after the mudcake was scraped (3358 minutes), the sandface pressure jumps from 5039 to 5089 psi, and then it declines with a slump at 3368 minutes. FIG. 5 shows the time evolution of mudcake thickness. Calculation results are from single-phase invasion model with input parameter in Table 1. It is observed that the mudcake thickness reduces to 0.034 cm from its maximum thickness of 0.2 cm suddenly at 3358 minutes when the mudcake was scraped, and grew faster after 3368 minutes when the hydrostatic pressure decreased. As shown in FIG. 6, the permeability of mudcake stabilized at $6.0\times10^{-6}$ mD before the cake was abraded; after scraping (before hydrostatic pressure change) the sandface pressure increases from 5039 to 5089 psi, causing the pressure difference across the mudcake to decrease, resulting in a slightly higher permeability ($6.3\times10^{-6}$ mD). Calculation results are from single-phase invasion model with input parameter shown in Table 1. After the hydrostatic pressure decreases from 5626 to 5417 psi, the pressure difference across the mudcake decreases correspondingly; the permeability increases to an even higher value ($8.7\times10^{-6}$ mD). Eventually, the permeability stabilizes to $8.1\times10^{-6}$ mD after the cake reaches the maximum thickness of 0.2 cm at 3440 minutes.

Field Case 2

The second field case relates to a time-lapse repeat testing case for well using a formation testing tool. The testing location depth was at 18,400 ft. Two sets of repeat tests (six tests) were conducted during drilling, and one set of repeat tests (three tests) was re-logged after three days. The three day time-lapse pressure difference was 14 psi due to dissipation of the supercharge pressure.

The first set of repeat pressure tests was conducted under 4026.7 psi of hydrostatic pressure, then the hydrostatic pressure was dropped to 4023.8 psi, and another three repeat pressure tests were conducted. The measured build-up pressures for the first set of repeat tests were 2850.3, 2849.9, and 2850.2 psi, respectively; and the build-up pressures for the second set of repeat tests were 2843.1, 2841.7, and 2841.2 psi, respectively. This decreasing trend of build-up pressure in repeat tests is believed to be a supercharging effect.

The objective function uses the four pressure measurements (i.e., the first and third measurements of both repeat tests). Inversion parameters are the initial formation pressure $P_i$, reference mudcake permeability $k_{mc0}$, mudcake compaction factor $\lambda_{mc1}$ (when hydrostatic pressure equals 4026.7 psi), mudcake compaction factor $\lambda_{mc2}$ (when hydrostatic pressure equals 4023.8 psi), skin S, and compressibility exponent v of mudcake. All the other parameters are assumed to be known: total compressibility $c_t$ is $3\times10^{-6}$ 1/psi, formation permeability is 5.0 mD from the formation testing tool data analysis, formation porosity is 0.3, fluid viscosity is 1 cp, wellbore radius is 10 cm, maximum thickness of mudcake is 0.5 cm. The first build-up pressure of the first repeat test set was measured 22.23 minutes after the drill bit passed this depth. The hydrostatic pressure decreased to 4023.8 at 32.23 minutes, and the first build-up pressure of the second set of repeat tests was measured at 32.95 minutes. The compaction factor is a step function of time:

$$\lambda_{mc}(t<32.23 \text{ minutes}) = \lambda_{mc1}$$

$$\lambda_{mc}(t \geqq 32.23 \text{ minutes}) = \lambda_{mc2}. \tag{11}$$

Figure 7:
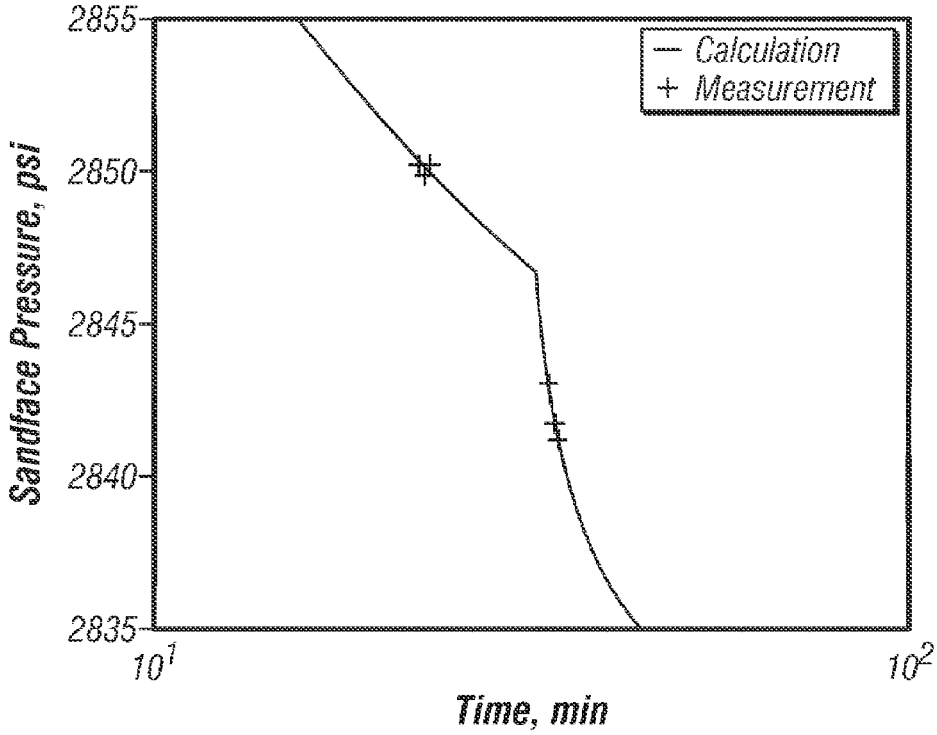
FIG. 7 shows sandface supercharged pressure for the Field Case 2.

The starting point for inversion is chosen as $P_i$=2800 psi, $k_{mc0}=1\times10^{-2}$ mD, $\lambda_{mc1}$=0.316, $\lambda_{mc2}$=0.316, S=3.0, and v=0.6. The inversion results for the L-M algorithm are summarized in Table 2 (FIG. 17). The second compaction factor $\lambda_{mc2}$ is approximately 15 times $\lambda_{mc1}$, indicating much faster mudcake growth. The change of hydrostatic pressure between two sets of tests is negligible; therefore, the decreasing mud circulation rate cannot be the reason for the much larger value of $\lambda_{mc2}$. This much larger value of $\lambda_{mc2}$ might be explained by two causes: (1) change of the azimuthal location of the probe during the second test in the horizontal borehole, which would explain the more rapid mudcake growth if the new test location is on the low side of a horizontal borehole; (2) mudcake grew faster because the mudcake was ablated shortly before the test. In this case, regardless of the cause, the mud cake growth is captured in the value of $\lambda_{mc2}$, and a perfect match of sandface pressures is obtained (see FIG. 7).

Figure 8A:
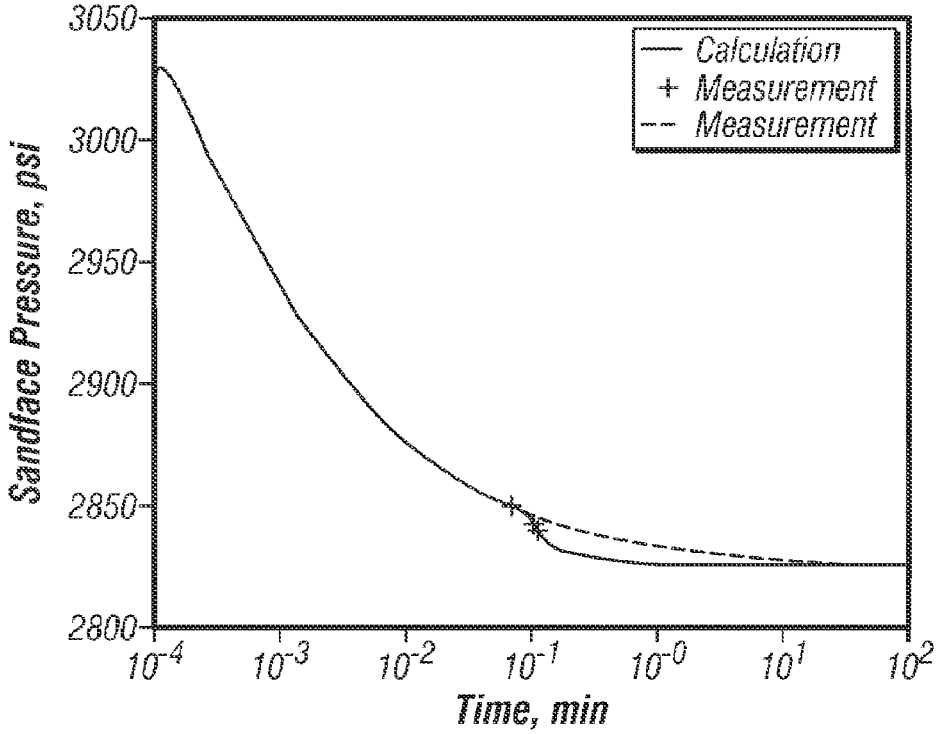
Figure 8B:
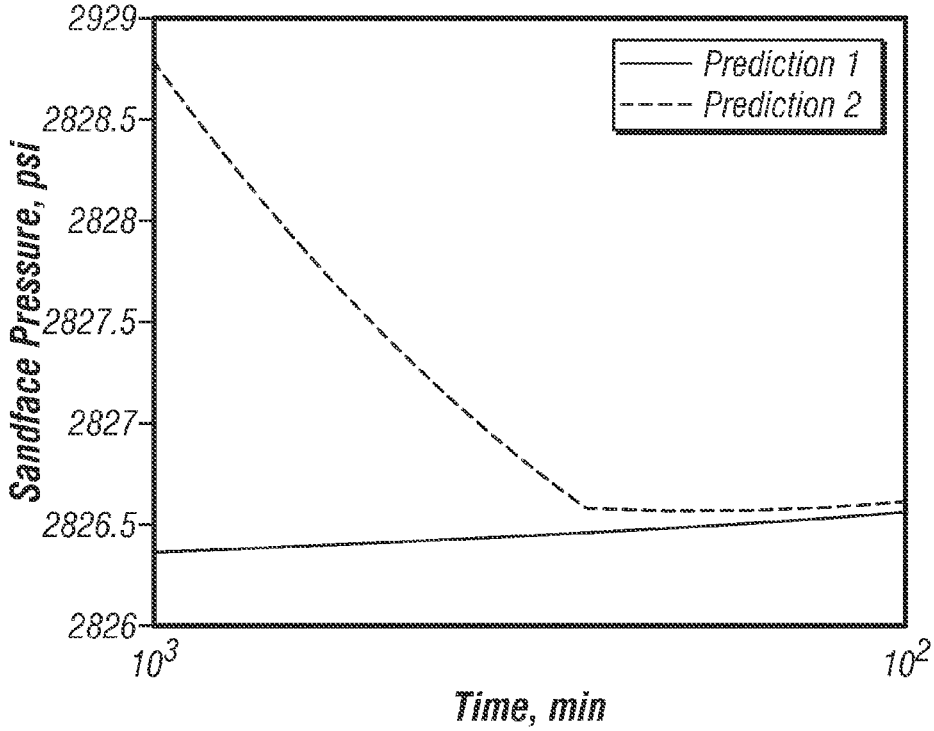
Figure 9:
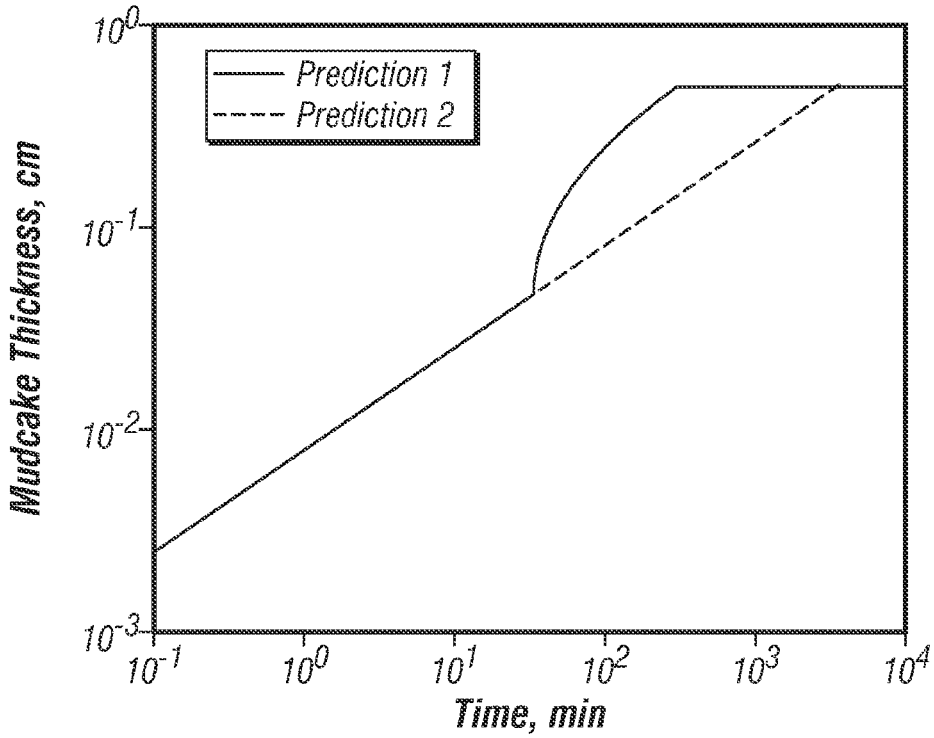
FIG. 9 shows time evolution of mudcake thickness for a Field Case 2.
Figure 10:
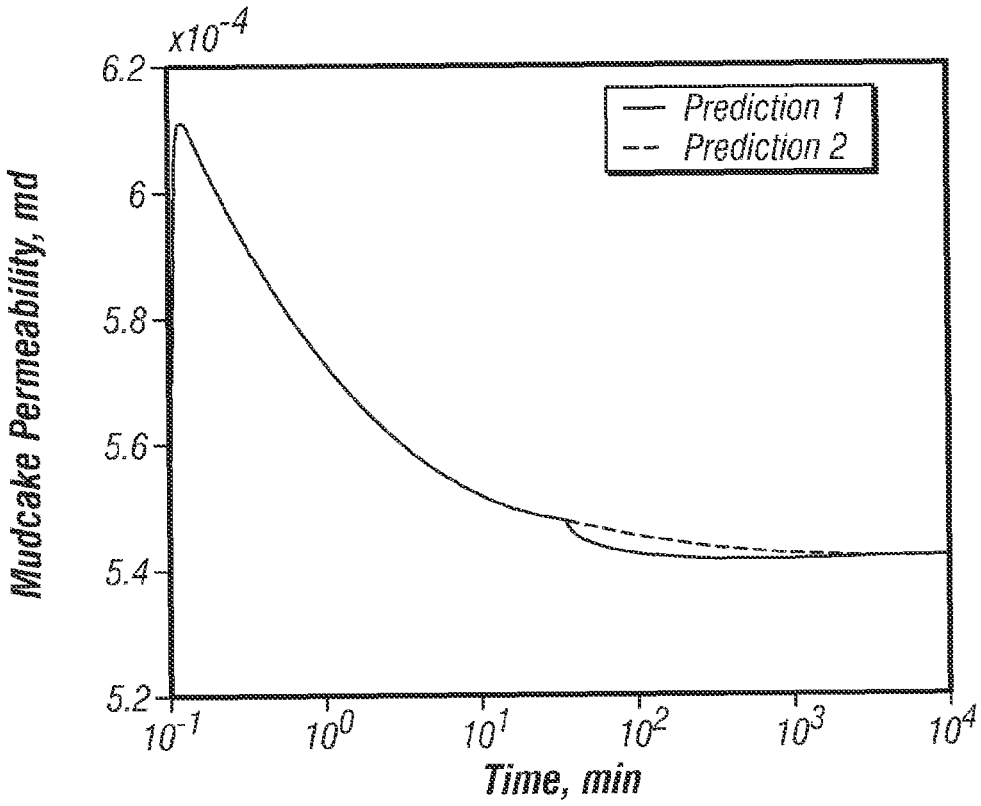
FIG. 10 shows time evolution of mudcake permeability for the Field Case 2.

Two pressure predictions are made using inversion results in order to match the third data set: Prediction 1 is simply the matched curve extending to three days; Prediction 2 is based on a constant value of $\lambda_{mc1}$=0.13. If the mudcake is left unchecked, the sandface pressure after three days (3981.92 minutes since drilled) may dissipate to a range between 2826.4 and 2826.6 psi as shown in FIGS. 8*a* & 8*b*. Results of Prediction 1 are from single-phase invasion model with input parameter shown in Table 2. Prediction 2 uses one constant compaction factor $\lambda_{mc1}$=0.13 for the entire test. As shown in FIG. 9, the mudcake thickness reaches maximum (0.5 cm) after 300 minutes for the case of Prediction 1, while it takes 3700 minutes for Prediction 2 to reach the same maximum thickness. Results of Prediction 1 are from single-phase invasion model with input parameter shown in Table 2. Prediction 2 uses one constant compaction factor $\lambda_{mc1}$=0.13 for the entire test period. After the maximum thickness is reached, the mudcake permeabilities are almost the same for both predictions as shown in FIG. 10. Results of Prediction 1 are from single-phase invasion model with input parameter shown in Table 2. Prediction 2 uses one constant compaction factor $\lambda_{mc1}$=0.13 for the entire test period.

According to Predictions 1 and 2, after three days of invasion, the sandface pressure would be approximately 2826.5 psi, just 2.7 psi above the initial formation pressure (the initial formation pressure is 2823.8 psi based on the inversion), and the change of sandface pressure during the third set of repeat tests will be insignificant (less than 0.1 psi) if the mudcake is not impaired. However, the pressure measurement of the third set of repeat tests (2839.1, 2837, and 2835.9 psi) indicates that the mudcake was damaged before the test. The last measured sandface pressure is 2835.9 psi, 12.1 psi above the calculated initial formation pressure.

Figure 11A:
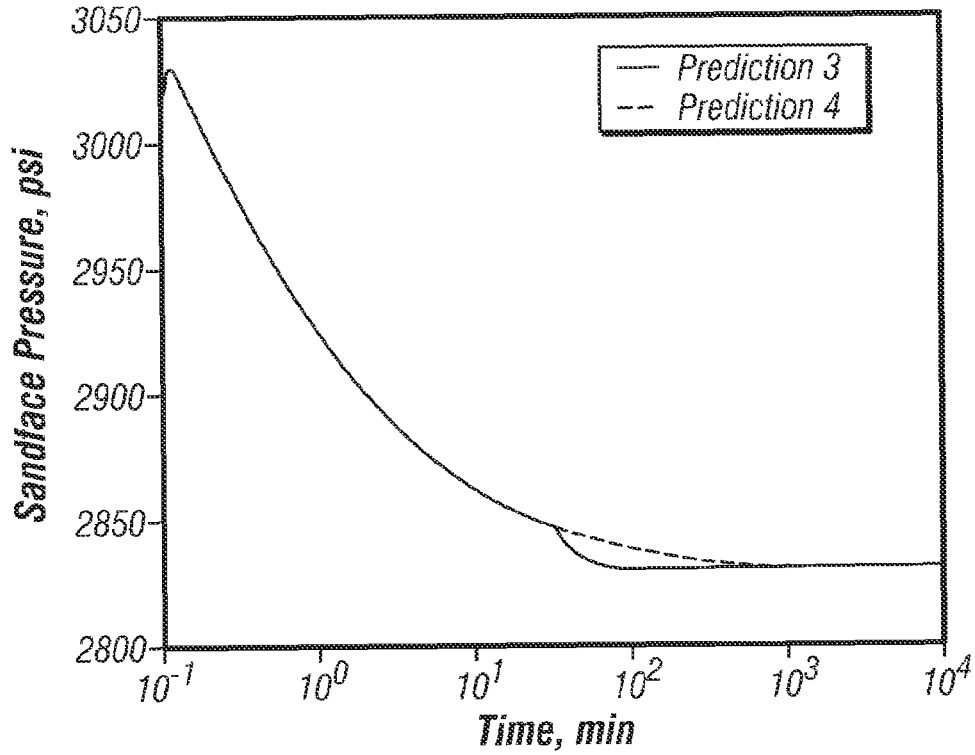
FIGS. 11*a* & 11*b* show sandface supercharged pressure for the Field Case 2.
Figure 11B:
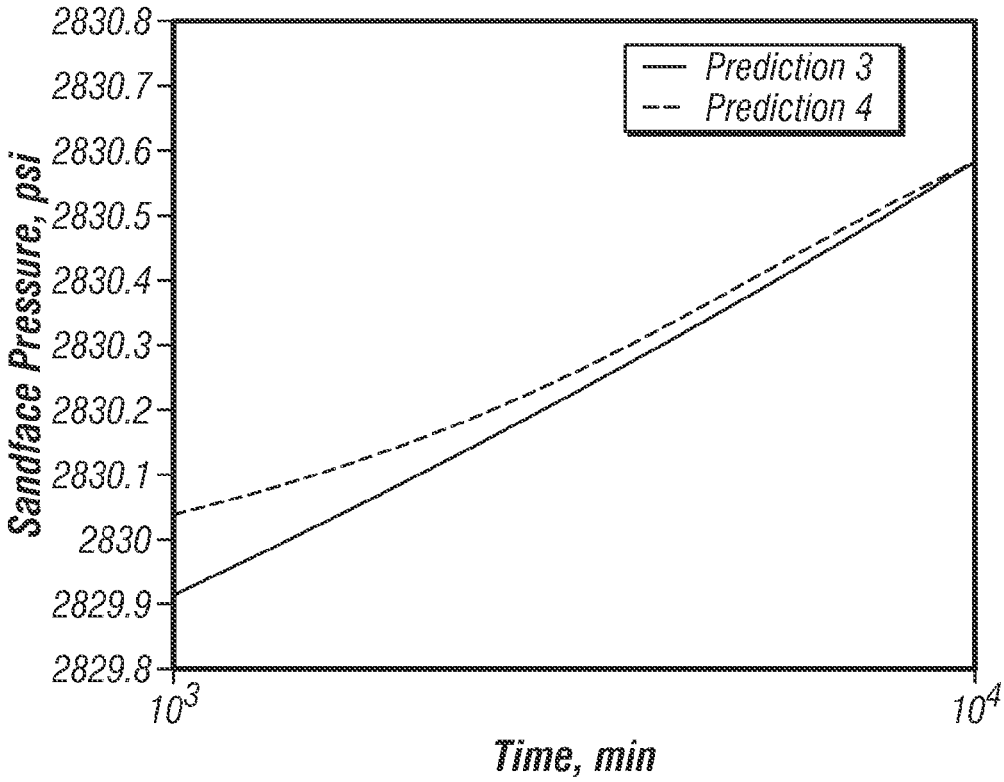

The maximum thickness of mudcake affects the sandface pressure prediction. One sensitivity study uses 0.2 cm as the maximum thickness instead of 0.5 cm. As shown in FIG. 9, the thickness of cake reached 0.2 cm after 70 minutes (approximately 40 minutes after first six measurements were taken); therefore, the inversion results, in order to match the first six tests, will be the same for this case. The new value of maximum thickness only affects the measurements after 70 minutes. Two more predictions are made using inversion results: Prediction 3 is forward simulation up to three days; Prediction 4 uses a constant value of $\lambda_{mc1}$=0.13 for the entire test period. Both predictions use 0.2 cm as the maximum thickness. As shown in FIGS. 11*a* & 11*b*, sandface pressure after three days (3981.92 minutes since drilled) will range from 2830.29 to 2830.33 psi, approximately 4 psi higher than Predictions 1 and 2 with maximum thickness of 0.5 cm. FIG. 11*b* is an enlargement of FIG. 11*a*. Maximum mudcake thickness is set to 0.2 cm for predictions 3 and 4. Results of Prediction 3 are from single-phase invasion model with input parameter given in Table 2. Prediction 4 uses a single constant compaction factor $\lambda_{mc1}$=0.13 for the entire test period.

The estimated initial formation pressure (2823.8 psi) based on the first six tests, is less than the pressure measured three days later, showing good agreement with time-lapse LWD pressure measurements.

A comparison with a numerical invasion simulator is described below. In this section, the results from the single-phase forward model of the disclosure are compared with those from a finite difference simulator. The finite difference simulator is based on the solution of the fluid-flow differential equations and boundary conditions for immiscible radial flow and coupled mudcake growth, Wu et al. "The influence of water-based mud properties and petrophysical parameters on mudcake growth, filtrate invasion and formation pressure." Petrophysics, 46, No. 1 pp. 1-32, 2005.

Figure 12:
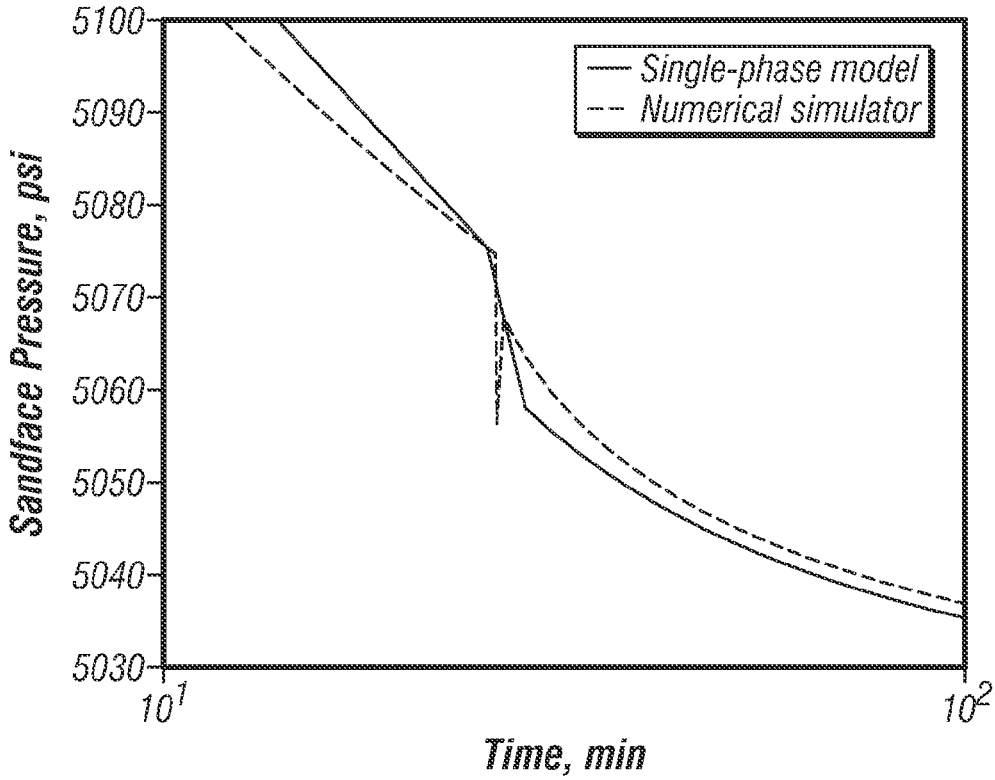
FIG. 12 shows time evolution of sandface pressure for Scenario 1-A of Field Case 1.

For the comparison, the same parameters as in Scenario 1-A of Field Case 1 are used. FIG. 12 shows the sandface pressure calculated using both methods. Both pressure curves exhibit the same trend; the maximum pressure difference is less than 4 psi from 30 to 100 minutes. The solid and dashed curves represent sandface pressure calculated from single-phase model and numerical simulator, respectively. The numerical simulator uses much smaller time steps during the transition period (approximately 26 minutes since drilled), and therefore, its result reveals more details. The downward spike at t=26 minutes is due to the mudcake compaction.

Figure 13:
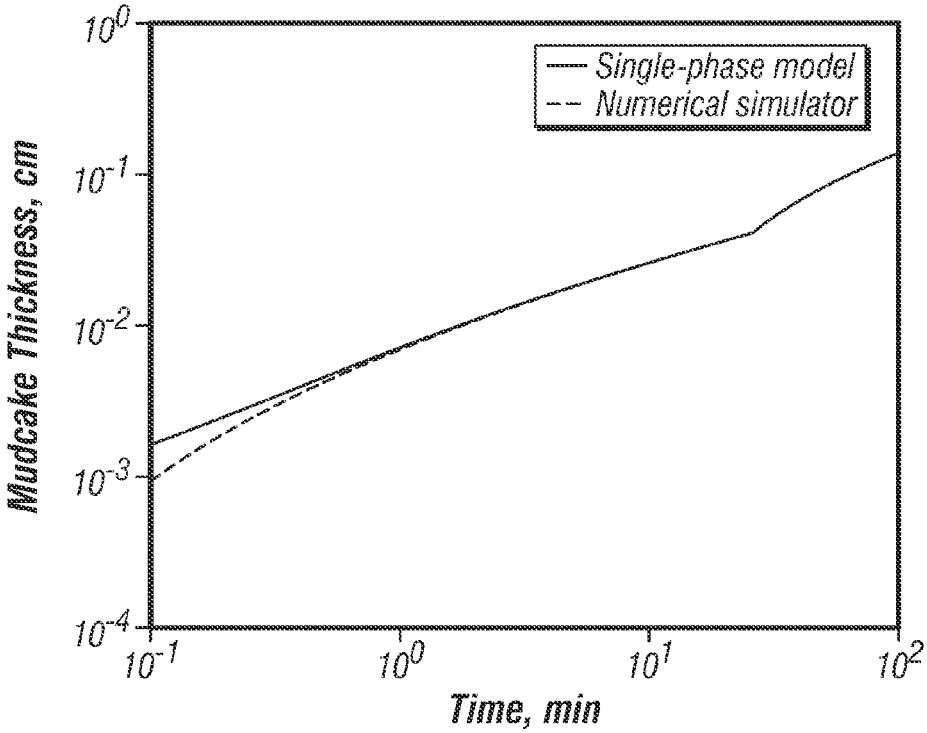
FIG. 13 shows time evolution of mudcake thickness for Scenario 1-A of Field Case 1.
Figure 14:
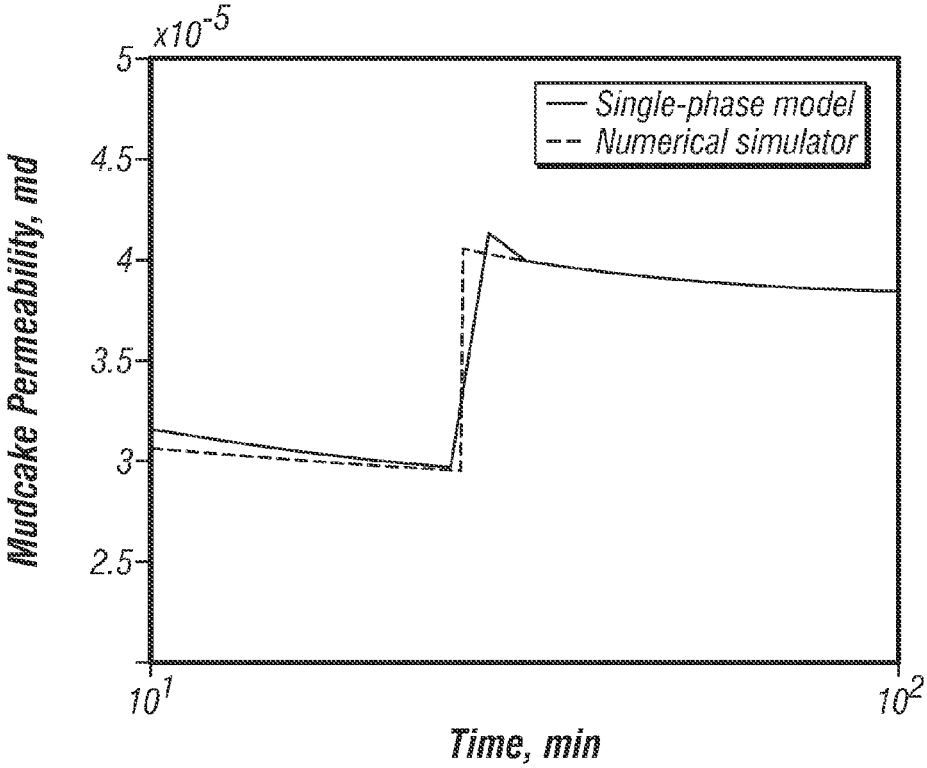
FIG. 14 shows time evolution of mudcake permeability for Scenario 1-A of Field Case 1.

FIG. 13 shows the time evolution of mudcake thickness for Scenario 1-A of Field Case 1. The solid and dashed curves represent mudcake thickness calculated from single-phase model and numerical simulator, respectively. FIG. 13 shows that the mudcake thicknesses are almost identical for both methods after 1 minute of invasion. FIG. 14 shows the time evolution of mudcake permeability for Scenario 1-A of Field Case 1. The solid and dashed curves represent mudcake thickness calculated from single-phase model and numerical simulator, respectively. The mudcake permeabilities shown in FIG. 14 are calculated from pressure across mudcake using Eq. 4. The solid and dashed curves represent mudcake thickness calculated from single-phase model and numerical simulator, respectively. The slight difference is consistent with differences between sandface pressures shown in FIG. 12. In summary, the single-phase model behaves similarly to numerical invasion simulator.

In another aspect, the present disclosure provides an alternative method for estimating the initial pressure $P_i$. In this method, the resistance to flow includes two parts: one is the mudcake resistance $R_m$; and the other is the formation resistance $R_i$. A pressures test sequence includes at least three repeat tests.

Assume the wellbore mud hydrostatic pressure $P_{mh}$ is constant during the test, and formation resistance $R_i$ can be treated as constant during the test. The sandface pressure $P_{ss}(t)$ and mudcake resistance $R_m(t)$ are functions of time t. The sandface pressures are measured at the end of pressure build-up at times noted as $t_1$, $t_2$, and $t_3$.

The pressure across mudcake for $t_1$, $t_2$, and $t_3$ are $P_{mh}-P_{ss}(t_1)$, $P_{mh}-P_{ss}(t_2)$, and $P_{mh}-P_{ss}(t_3)$, respectively. Equations (A1) to (A3) given below show that pressure across mudcake ($P_{mh}-P_{ss}$) is a fraction of overbalance pressure ($P_{mh}-P_i$).

$$P_{mh} - P_{ss}(t_1) = (P_{mh} - P_i)\frac{R_m(t_1)}{R_i + R_m(t_1)}, \tag{A1}$$

$$P_{mh} - P_{ss}(t_2) = (P_{mh} - P_i)\frac{R_m(t_2)}{R_i + R_m(t_2)}, \tag{A2}$$

$$P_{mh} - P_{ss}(t_3) = (P_{mh} - P_i)\frac{R_m(t_3)}{R_i + R_m(t_3)}, \tag{A3}$$

Assume that during the test, $R_m$ is changing linearly with time, $$R_m(t_2)=R_m(t_1)(1+G\cdot(t_2-t_1)), \tag{A4}$$

$$R_m(t_3)=R_m(t_1)(1+G\cdot(t_3-t_1)), \tag{A5}$$

where G is the growth rate, its unit is second$^{-1}$. It is an indicator of mudcake growth speed. The higher the value of G, the faster the mudcake will grow.

Equation (A1) divided by Equation (A2) gives $$\frac{P_{mh}-P_{ss}(t_1)}{P_{mh}-P_{ss}(t_2)}=\frac{R_m(t_1)}{R_i+R_m(t_1)}\cdot\frac{R_i+R_m(t_1)(1+G(t_2-t_1))}{R_m(t_1)(1+G(t_2-t_1))},\tag{A6}$$

similarly, Equation (A1) divided by Equation (A3) gives $$\frac{P_{mh}-P_{ss}(t_1)}{P_{mh}-P_{ss}(t_2)}=\frac{R_m(t_1)}{R_i+R_m(t_1)}\cdot\frac{R_i+R_m(t_1)(1+G(t_3-t_1))}{R_m(t_1)(1+G(t_3-t_1))}.\tag{A7}$$

$$\text{Let } R_i=C\cdot R_m(t_1),\ a=\frac{P_{mh}-P_{ss}(t_1)}{P_{mh}-P_{ss}(t_2)},\ b=\frac{P_{mh}-P_{ss}(t_1)}{P_{mh}-P_{ss}(t_3)},$$

Equations (A6) and (A7) become Equations (A8) and (A9):

$$a=\frac{1}{C+1}\cdot\frac{C+(1+G(t_2-t_1))}{(1+G(t_2-t_1))},\tag{A8}$$

$$b=\frac{1}{C+1}\cdot\frac{C+(1+G(t_3-t_1))}{(1+G(t_3-t_1))}.\tag{A9}$$

There are two unknown variables in Equations (A8) and (A9), i.e., C and G. By solving Equations (A8) and (A9), G and C are obtained as follows, $$G=\frac{(1-a)}{(t_2-t_1)(a-b)}-\frac{(1-b)}{(t_3-t_1)(a-b)},\tag{A10}$$

$$C=\frac{(t_3-t_2)(1-a)(1-b)}{(t_3-t_1)b-(t_2-t_1)a-(t_3-t_2)ab},\tag{A11}$$

Initial formation pressure is calculated by substituting C into Equation (A1), $$P_i=(1+C)\cdot P_{ss}(t_1)-C\cdot P_{mh}.\tag{A12}$$

The method is demonstrated by the following two examples. Example 1 uses the first set of pressure measurements in Field Case 1, while Example 2 uses the second set of pressure measurements in Field Case 1.

EXAMPLE 1

$P_{mh}$=5626.11 psi, $P_{ss}(t_1)$=5087.72 psi, $P_{ss}(t_2)$=5083.63 psi, and $P_{ss}(t_3)$=5080.66 psi, $(t_2-t_1)$=110 second, $(t_3-t_2)$=96 second, a and b are calculated to be 0.992461 and 0.987057. C=0.07808, G=0.001056, $P_i$ is estimated to be 5045.68 psi.

EXAMPLE 2

$P_{mh}$=5417 psi, $P_{ss}(t_1)$=5055.75 psi, $P_{ss}(t_2)$=5053.25 psi, and $P_{ss}(t_3)$=5051.42 psi, $(t_2-t_1)$=120 second, $(t_3-t_2)$=140 second, a and b are calculated to be 0.993127 and 0.988156. C=0.03217, G=0.002357, $P_i$ is estimated to be 5044.13 psi.

The value of G is an indication of mudcake growth speed. The higher the value of G, the faster the mudcake will grow. When the hydrostatic pressure decreased from 5626 to 5417 psi, the value of G increased from 0.001056 to 0.002357, indicating that mudcake grew faster. This observation generally agrees with the inversion results shown in Table 1. The method using the model of equations A1, A2 and A3 provided relatively quickly the initial pressure by directly using at least three formation pressure measurements and the hydrostatic pressure.

Alternately, $R_m$ can be assumed to change with square root of time.

$$R_m(t_2)=R_m(t_1)\sqrt{1+G\cdot(t_2-t_1)},\tag{A13}$$

$$R_m(t_3)=R_m(t_1)\sqrt{1+G\cdot(t_3-t_1)},\tag{A14}$$

Equation (A1) divided by Equation (A2) gives $$\frac{P_{mh}-P_{ss}(t_1)}{P_{mh}-P_{ss}(t_2)}=\frac{R_m(t_1)}{R_i+R_m(t_1)}\cdot\frac{R_i+R_m(t_1)\sqrt{1+G\cdot(t_2-t_1)}}{R_m(t_1)\sqrt{1+G\cdot(t_2-t_1)}},\tag{A15}$$

similarly, Equation (A1) divided by Equation (A3) gives $$\frac{P_{mh}-P_{ss}(t_1)}{P_{mh}-P_{ss}(t_2)}=\frac{R_m(t_1)}{R_i+R_m(t_1)}\cdot\frac{R_i+R_m(t_1)\sqrt{1+G\cdot(t_3-t_1)}}{R_m(t_1)\sqrt{1+G\cdot(t_3-t_1)}}.\tag{A16}$$

$$\text{Let } R_i=C\cdot R_m(t_1),\ a=\frac{P_{mh}-P_{ss}(t_1)}{P_{mh}-P_{ss}(t_2)},\ b=\frac{P_{mh}-P_{ss}(t_1)}{P_{mh}-P_{ss}(t_3)},$$

Equations (A15) and (A16) become Equations (A17) and (A18):

$$a=\frac{1}{C+1}\cdot\frac{C+\sqrt{1+G(t_2-t_1)}}{\sqrt{1+G\cdot(t_2-t_1)}},\tag{A17}$$

$$b=\frac{1}{C+1}\cdot\frac{C+\sqrt{1+G\cdot(t_3-t_1)}}{\sqrt{1+G\cdot(t_3-t_1)}}.\tag{A18}$$

There are two unknown variables in Equations (A17) and (A18), i.e., C and G. By solving Equations (A17) and (A18), G and C are obtained.

Initial formation pressure is calculated by substituting C into Equation (A12).

The method is demonstrated by the following two examples. Example 3 uses the first set of pressure measurements in Field Case 1, while Example 4 shows a case with increasing pressures.

EXAMPLE 3

$P_{mh}$=5626.11 psi, $P_{ss}(t_1)$=5087.72 psi, $P_{ss}(t_2)$=5083.63 psi, and $P_{ss}(t_3)$=5080.66 psi, $(t_2-t_1)$=110 second, $(t_3-t_2)$=96 second, a and b are calculated to be 0.992461 and 0.987057. C=0.1174, G=0.001460, $P_i$ is estimated to be 5024.50 psi.

EXAMPLE 4

$P_{mh}$=4888.11 psi, $P_{ss}(t_1)$=3756.59 psi, $P_{ss}(t_2)$=3756.90 psi, and $P_{ss}(t_3)$=3757.25 psi, $(t_2-t_1)$=41.92 second, $(t_3-t_2)$=73.39 second, a and b are calculated to be 1.000274 and 1.0005836. C=0.001867, G=−0.005723, $P_i$ is estimated to be 3754.48 psi.

Other alternative growth models of mudcake resistance may be adopted, such as $$R_m(t)=R_m(t_1)(1+G\cdot(t-t_1))^n,\tag{A19}$$

$$\text{or } R_m(t)=R_m(t_1)e^{(G(t-t_1))^n},\tag{A20}$$

where n is an arbitrary real number.

After similar procedures as described above, two unknown variables (C and G) are obtained by solving two Equations. Then Initial formation pressure is calculated by substituting C into Equation (A12).

This method can be applied to formation tester repeat tests with either decreasing or increasing pressures. The initial pressure estimated from this method may serve as initial point for the inversion algorithm.

Figure 15:
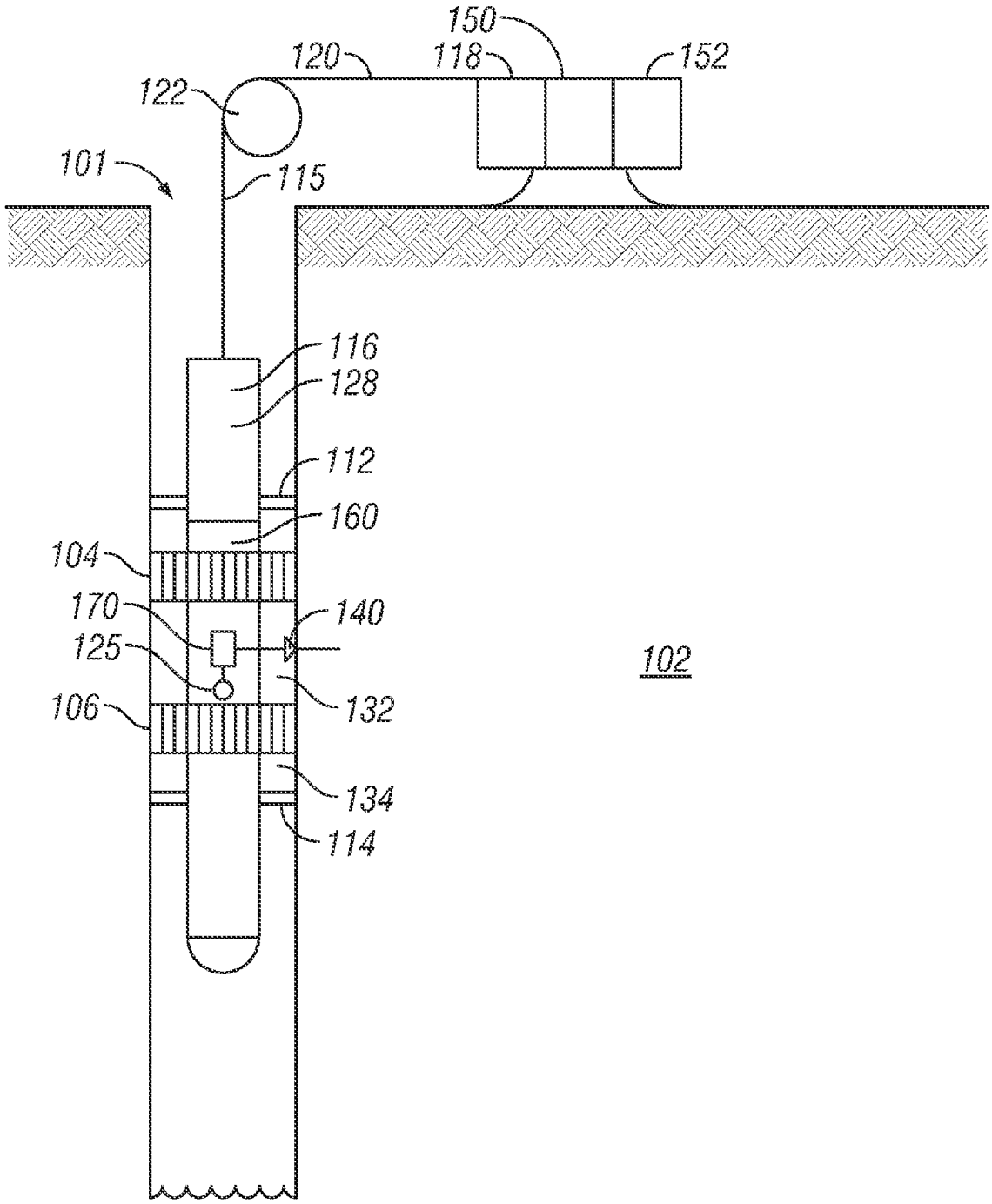
FIG. 15 is a schematic diagram of an exemplary system that may be utilized to perform the methods of the present disclosure.

FIG. 15 shows a schematic diagram of an exemplary wireline system that may be utilized to perform the methods described herein, according to one embodiment of the present invention. A well 101 is shown traversing a formation 102. A wireline tool 103 supported by an armored cable 115 is disposed in the well 101 adjacent the formation 102. Extending from the tool 103 are optional grippers 112 and 114 for stabilizing the tool 103. Two optional expandable packers 104 and 106 disposed on the tool 103 may be used to separate the annulus of the borehole 101 into an upper annulus 130, a sealed intermediate annulus 132 and a lower annulus 134. A selectively extendable pad member 140 is disposed on the tool 103. The grippers 112, packers 104 and 106, and extendable pad element 140 are used to withdraw the fluid from the formation 102. The tool 103 further includes a probe in the pad 140 to withdraw the formation fluid into a line. A pressure sensor 170 measures the pressure over time. A strain gauge or a quartz gauge may be used to measure the pressure over time. The tool 103 also includes a plurality of other sensors, such a temperature, sensors, optical sensors, etc.

Telemetry for the wireline embodiment includes a downhole two-way communication unit 116 connected to a surface two-way communication unit 118 by one or more conductors 120 within the armored cable 115. The surface communication unit 118 is housed within a surface controller 150 that includes a processor and, memory 152, and output device 152. A typical cable sheave 122 is used to guide the armored cable 115 into the borehole 101. The tool 103 includes a downhole controller 160 having a processor and memory (not shown) for controlling formation tests in accordance with methods described herein. The models described herein may be stored in memory associated with the downhole controller and/or the surface controller. The controller, using the measured test data and the models executes programmed instructions to perform the methods described herein. Alternatively, the components described herein may be configured in an LWD too conveyable in a wellbore for use during drilling of a wellbore. Thus, the disclosure herein applies equally to the wireline and drilling applications.

The Nomenclature used in this disclosure is as follows:

B the formation volume factor
$c_t$ the total compressibility
$f_s$ solid fraction of mud
h the formation thickness
$K_n$ the modified Bessel function of order n of the second kind (n=0,1)
k formation permeability
$k_{mc}$ mudcake permeability
$k_{mc0}$ reference permeability defined at 1 psi differential pressure
$k_s$ permeability of the 'skin-damaged' zone (internal mudcake)
$l_{mc}$ mudcake thickness
$l_{mc0}$ mudcake thickness after scraping
$P_i$ initial formation pressure
$P_{mh}$ wellbore mud hydrostatic
$P_{ss}$ the sandface supercharge pressure
q invasion rate
$r_s$ the radius of 'skin-damaged' zone
$r_w$ wellbore radius
S Skin (internal mudcake)
s independent variable in Laplace domain
t time elapsed between the measurement and the exposure of the formation to the wellbore after it has been drilled (time since Drilled)
v compressibility exponent, typically in the range of 0.4 to 0.9
$\Delta P_{ss}$ (s) the sandface pressure change in Laplace transform domain
$\Delta P_{ss}$ (t) the sandface pressure change in time domain
$\mu$ fluid viscosity
$\phi$ formation porosity
$\phi_{mc}$ mudcake porosity
$\lambda_{mc}$ mudcake compaction factor
$\eta$ diffusivity constant The foregoing description is directed to particular features of the system and method for estimating supercharge pressure and initial pressure of a formation for the purpose of illustration and explanation. It will be apparent, however, to one skilled in the art that many modifications and changes to the embodiment set forth above are possible. It is intended that all such changes and modifications be interpreted as part of the disclosure.

What is claimed is:

1. A method for estimating a formation pressure in a wellbore, comprising:

obtaining a hydrostatic pressure from a measurement made by a downhole tool at a selected location in the wellbore; and obtaining formation mobility and build-up pressure measurements at the selected location by conducting a formation test;

estimating a supercharge pressure as a function of time using a forward model that utilizes the hydrostatic pressure, a skin factor, and at least one property of mud or mudcake in the wellbore that is a function of time; and estimating the formation pressure using the buildup pressure measurement and the estimated supercharge pressure.

2. The method of claim 1, wherein the forward model further uses an invasion rate.

3. The method of claim 1, wherein the forward model further uses a skin factor to account for an internal mudcake associated with the wellbore for estimating the supercharge pressure as a function of time.

4. The method of claim 1, wherein the forward model uses a wellbore internal dimension for estimating the pressure supercharge as a function of time.

5. The method of claim 1 further comprising:

obtaining at least three pressure measurements at three separate times in the wellbore at the selected location under a second hydrostatic pressure;

performing an inversion scheme on the at least three pressures measurements and the estimated supercharge pressure over time to estimate an initial pressure at the location.

6. The method of claim 1, wherein the forward model is a single phase forward model that uses a Laplace transform.

7. The method of claim 6, wherein the forward model is expressed as:

$$\Delta P_{ss}(s) = \frac{qB\mu}{2\pi kh}\frac{K_0\left(\sqrt{s/\eta}\,r_w\right) + S\sqrt{s/\eta}\,r_w K_1\left(\sqrt{s/\eta}\,r_w\right)}{s\sqrt{s/\eta}\,r_w K_1\left(\sqrt{s/\eta}\,r_w\right)},$$

$$\eta = \frac{k}{\phi c_t \mu}, \text{ and}$$

$$\Delta P_{ss}(t) = P_{ss}(t) - P_i,$$

where $\Delta P_{ss}$ (s) is a sandface supercharge pressure change in a Laplace transform domain, $\Delta P_{ss}$ (t) is a sandface supercharge pressure change in a time domain, $P_{ss}$ is the sandface supercharge pressure, $P_i$ is an initial formation pressure, q is an invasion rate, B is a formation volume factor, μ is a fluid viscosity, s is an independent variable in the Laplace domain, $r_w$ is a wellbore radius, η is a diffusivity constant, ϕ is a formation porosity, $c_t$ is a total compressibility, k is a formation permeability, h is a formation thickness, S is a skin factor for an internal mudcake, t is time, and $K_n$ is a modified Bessel function of order n of a second kind (n=0,1).

8. The method of claim 1, wherein the forward model uses a fluid flow model and a mudcake growth model.

9. The method of claim 8, wherein the at least one property of mud or mudcake is one of a mudcake porosity, a solid fraction of mud, and mudcake compaction factor and wherein the mudcake growth model provides a mudcake thickness.

10. The method of claim 9, wherein the mudcake growth model further uses a mudcake permeability that is a function of pressure in determining a mudcake growth rate.

11. A method of estimating an initial formation pressure at a selected location in a wellbore, comprising:

taking at least three pressure measurements at three separate times at the selected location in the wellbore;

taking a hydrostatic pressure measurement substantially at the selected location; and estimating the initial formation pressure at the selected location using the hydrostatic pressure, a skin factor, the three pressure measurements and an internal mudcake parameter.

12. The method of claim 11, wherein the internal mudcake parameter is a mudcake growth rate.

13. The method of claim 11, wherein the internal mudcake parameter is a flow resistance of mudcake at each of the three times.

14. An apparatus for use in a wellbore for estimating an initial formation pressure, comprising a pressure sensor configured to measure hydrostatic pressure at a selected location in the wellbore;

a memory device that stores a forward model that utilizes as inputs the hydrostatic pressure, a skin factor, and at least one property of mud that is a function of time; and a processor configured to use an output of the forward model and a measured build-up pressure to estimate the initial pressure of the formation at the selected location.

15. The apparatus of claim 14, wherein the forward model further uses a skin factor as an input to account for an internal mudcake associated with the wellbore for estimating the initial pressure.

16. The apparatus of claim 14 further comprising a probe that is configured to press against an inner surface of the wellbore for obtaining at least three pressure measurements of the formation at three separate times, and wherein the processor uses an inversion algorithm on the at least three pressure measurements and an estimated supercharge pressure over time to estimate the initial pressure at the selected location.

17. The apparatus of claim 14, wherein the forward model uses a fluid flow model and a mudcake growth model.

18. The apparatus of claim 17, wherein the at least one property of the mud is one of a mudcake porosity and mudcake compaction factor and wherein the mudcake growth model provides a mudcake thickness, from which an invasion rate of mud filtrate is calculated using Darcy's law.

19. The apparatus of claim 18, wherein the forward model further uses the invasion rate.

20. The apparatus of claim 18, wherein the mudcake growth model further uses a mudcake permeability that is a function of pressure in determining the mudcake thickness as a function of time.

21. An apparatus for use in a wellbore for estimating an initial pressure, comprising:

a pressure sensor configured to measure hydrostatic pressure and at least three formation pressure measurements at three spaced apart times at selected location in the wellbore;

a memory device that stores the hydrostatic pressure measurement, the at least three formation pressure measurements and a model that uses an internal mudcake parameter; and a processor associated with the tool that is configured to estimate the initial formation pressure at the selected location using the hydrostatic pressure, a skin factor, the three pressure measurements and the model to estimate the initial formation pressure at the selected location.

22. The apparatus of claim 21, wherein the internal mudcake parameter is one of: a mudcake growth rate; and a flow resistance of mudcake at each of the three spaced apart times.

* * * * *